US006817618B2

(12) United States Patent
Furzer et al.

(10) Patent No.: US 6,817,618 B2
(45) Date of Patent: Nov. 16, 2004

(54) HEATING ARRANGEMENT FOR ICE SKATE BLADES

(75) Inventors: Jeremy Furzer, Sherwood Park (CA); Tory Weber, Sherwood Park (CA)

(73) Assignee: Therma Blade Inc., Sherwood Park (CA)

( * ) Notice: Subject to any disclaimer, the term of this patent is extended or adjusted under 35 U.S.C. 154(b) by 0 days.

(21) Appl. No.: 10/459,713

(22) Filed: Jun. 12, 2003

(65) Prior Publication Data

US 2004/0032097 A1 Feb. 19, 2004

Related U.S. Application Data

(63) Continuation-in-part of application No. 10/015,221, filed on Dec. 12, 2001, now Pat. No. 6,669,209.

(51) Int. Cl.[7] ..... A63C 1/00
(52) U.S. Cl. ..... 280/11.12; 219/201; 219/211
(58) Field of Search ..... 280/11.12, 11.14, 280/11.18, 841; 36/2.6, 119; 219/201, 209, 211, 482, 507, 527

(56) References Cited

U.S. PATENT DOCUMENTS 3,119,921 A * 1/1964 Czaja ..... 219/201
3,866,927 A * 2/1975 Tvengsberg ..... 280/11.12
4,034,489 A 7/1977 Hughes, Jr.
5,441,305 A * 8/1995 Tabar ..... 280/809
5,973,293 A * 10/1999 Reichman ..... 219/211
6,229,132 B1 5/2001 Knetter
6,669,209 B2 * 12/2003 Furzer et al. ..... 280/11.12

* cited by examiner

*Primary Examiner*—Christopher P. Ellis
*Assistant Examiner*—J. Allen Shriver
(74) *Attorney, Agent, or Firm*—Adrian D. Battison; Michael R. Williams; Ryan W. Dupuis

(57) ABSTRACT

An ice skate comprising a boot arranged to receive a person's foot, a skate blade assembly and a blade heating arrangement mounted within a blade mounting arrangement. The blade heating arrangement is arranged to use a field-effect transistor controlled by a microprocessor to operate in the non-linear range to heat skate blades from a power source. The blade is formed as a two part structure with a central core plate within the steel blade part of a higher thermal conductivity material such as copper. The circuit controlling the heating includes a charging component which uses as a contact for the charging current the blade itself.

13 Claims, 4 Drawing Sheets

3
57
2
58
14
56A
56
1

51
52
58
54
53
59
57
60
55
50

HEATING ARRANGEMENT FOR ICE SKATE BLADES

This application is a continuation-in-part application from application Ser. No. 10/015,221 filed Dec. 12, 2001.

FIELD OF THE INVENTION

The present invention relates to a heating arrangement for ice skate blades.

BACKGROUND

Common ice skates used in skating have an elongate blade which is arranged to slide along the ice surface. Attempts to minimise the friction between the blade and the ice using heat are shown in U.S. Pat. No. 3,119,921 (Czaja) and U.S. Pat. No. 3,866,927 (Tvengsberg) which use resistance heating to heat a blade on a skate. Resistance heating uses a high amount of energy and providing enough power to maintain a heated blade for a sufficient length of time would need a large power source. Since the optimal situation is to have a light skate, the above examples would be relatively heavy and cumbersome to use, specifically in prolonged uses. U.S. Pat. No. 5,441,305 (Tabar) discloses a heating system primarily for skis which appears to be speculative in nature and includes a number of different arrangements which could be used.

SUMMARY

It is an object of the present invention to provide an ice skate including a heating system which reduces the co-efficient of friction of the blade on the ice.

According to an aspect of the present invention there is provided an ice skate comprises:

a boot arranged to receive a person's foot;

a skate blade assembly;

a blade mounting arrangement is arranged to be connected to a sole of the boot and arranged to support a skate blade thereon, and;

a blade heating arrangement having a battery power source and a heating element for generating heat from electrical power supplied by the battery power source;

wherein the skate blade includes a steel blade portion and an insert portion embedded within the steel blade portion formed of a material having a higher thermal conductivity than the steel blade portion;

and wherein a part of the insert portion extends from the skate blade upwardly therefrom to the heating element to form a heat transfer member for transferring heat from the heating element to the steel blade portion.

Preferably the insert portion is a plate parallel to a plane of the skate blade with the steel blade portion covering both sides of the plate.

Preferably the plate extends along a part only of the length of the steel blade portion.

Preferably the plate extends to a bottom edge of the steel blade portion.

Preferably the blade heating arrangement uses a field-effect transistor controlled by the microprocessor to operate in the non-linear range to heat the skate blade. This arrangement where the field effect transistor, or other suitable semi-conductor, is controlled by signals supplied thereto to operate in its non-linear range to generate a very high power throughput and thus very high heating effect is particularly suitable for heating as opposed to conventional low efficiency resistance heating systems. However other heating elements can be used.

Preferably at least part of the heating arrangement including the battery power source is mounted within the mounting arrangement and the insert portion extends from the blade to the mounting arrangement.

Preferably the blade heating arrangement has a motion sensor arranged to control the heating of the blade such that when the skate is in use the blade is heated, when the skate is not in use the heat is off.

Preferably the blade has sides which are insulated by a plastic material to provide an insulating layer between the blade and the air.

According to a second aspect of the invention there is provided an ice skate comprises:

a boot arranged to receive a person's foot;

a skate blade assembly;

a blade mounting arrangement is arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element;

wherein a contact for connection to a charging system for charging the battery power source is defined by the blade.

In this aspect, preferably the blade heating arrangement uses a field-effect transistor controlled by a microprocessor to operate in the non-linear range to heat the skate blade.

Preferably at least part of the heating arrangement including the battery power source is mounted within the mounting arrangement and the heat transfer member extends from the blade to the mounting arrangement.

According to a third aspect of the invention there is provided a combination of an ice skate and a charger therefor comprising:

an ice skate comprising:

a boot arranged to receive a person's foot;

a skate blade assembly;

a blade mounting arrangement is arranged to be connected to a sole of the boot and arranged to support a skate blade thereon, and;

a blade heating arrangement having a rechargeable battery power source and a heating element for generating heat from electrical power supplied by the battery power source;

a heat transfer member extending from the heating element to the blade;

an electrical circuit arranged for controlling supply of battery power to the heating element and for controlling charging of the rechargeable battery;

and a charging system comprising;

a skate guard having a support for the blade of the skate;

a first contact for engaging the blade;

and a second contact for engaging the skate at a position thereon spaced from the blade.

Preferably the first contact and the second contact are connected to a port on the skate guard for connection to a separate charger.

BRIEF DESCRIPTION OF THE DRAWINGS

In the accompanying drawings, which illustrate an exemplary embodiment of the present invention.

DETAILED DESCRIPTION

Figure 1:
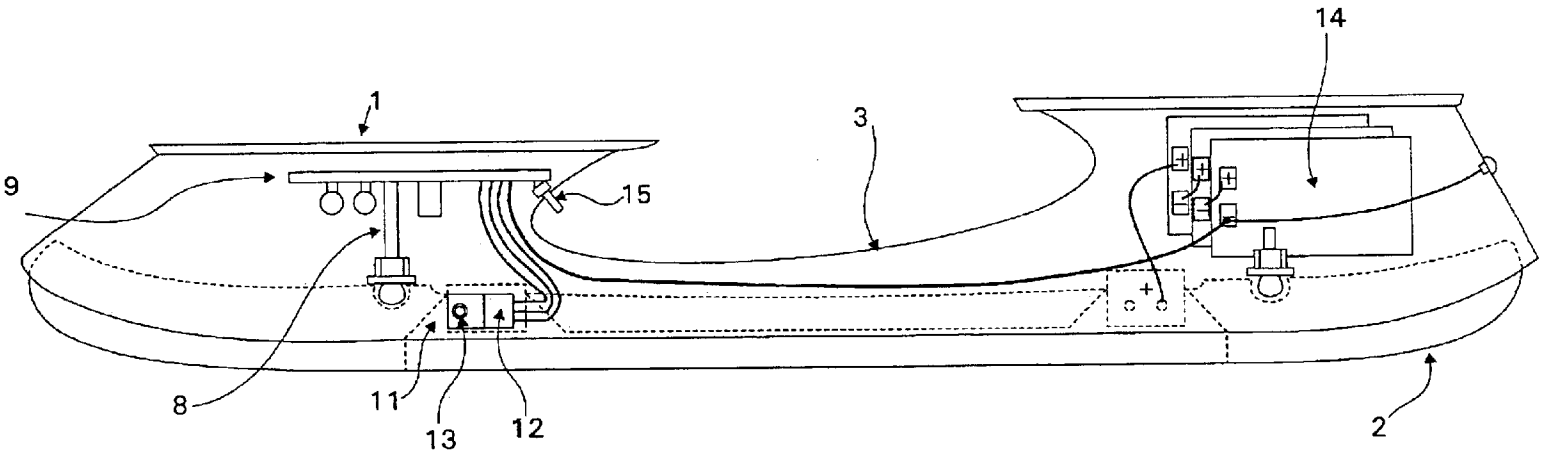
FIG. 1 is a side view of a heated skate according to the present invention.
Figure 2:
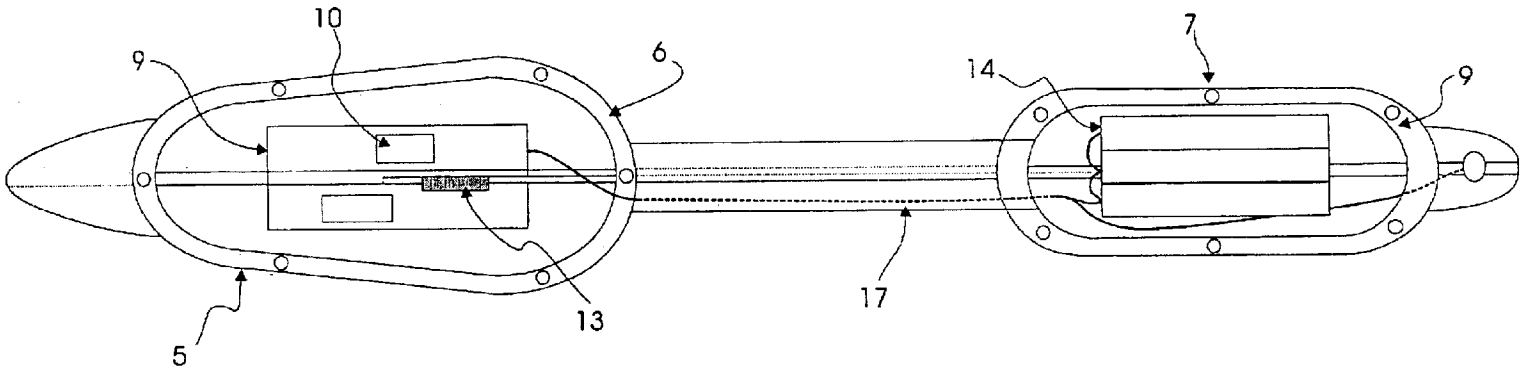
FIG. 2 is a top view of the embodiment of FIG. 1 showing the heating arrangement and power supply.

Referring to the accompanying drawings FIGS. 1 and 2, there is illustrated an ice skate blade assembly 1. The skate blade assembly is of the conventional ice skate type having a blade 2 and a holder 3 to support the blade. The holder has a heel 4, toe 5 and a sole plate flange 6. The sole plate flange has holes 7. The skate blade assembly 1 is generally fastened through the sole plate flange holes 7 through matching holes in the sole of an ice skate boot (not shown) with mechanical fasteners (not shown). The heel 4 and the toe 5 of the skate blade holder 3 generally are hollow.

A heating arrangement 8 is arranged to use an electronic heating circuit to heat the skate blade such that the heat reduces the coefficient of friction of the blade 2 on an ice surface. The heating arrangement 8 has a circuit board 9 mounted in the hollow part of the holder. The heating arrangement circuit has a microprocessor 10, a thermal conductor 11, a transistor 12 and a temperature sensor 13. The heating arrangement is powered by a battery 14. The battery 14 is connected via an on/off switch 15 to the heating circuit with an insulated wire 17 and by the skate blade 2 utilizing it as an electrical conductor.

The thermal conductor 11 is enclosed within the skate blade 2 and, is arranged to be concealed within the skate blade holder 3 or it may extend below the skate blade holder. A portion of the thermal conductor 11 is arranged to extend up into the hollow interior of the blade holder 3 and connect to the transistor 12 which produces the heat.

The skate blades 2 are optionally coated on the side surfaces with a non-stick compound such as Polytetrafluoroethylene (PTFE) to provide an insulating layer between the blade and the air. The non-stick coating also serves to minimise incrustation of ice on the sides of the blade.

Optionally the circuit board 9 has recordable electronic memory for storage of data collected from the electronic devices and or sensors.

Optionally the microprocessor 10 has an internal clock. The clock is used by the microprocessor to execute instructions or functions or collect data on a time counted basis.

Optionally the circuit board 9 has an integral motion sensor 18 used detect the presence or the lack of motion and or to detect the magnitude and frequency of motion. The motion sensor may signal an instruction in the microprocessor and or may store motion data in the electronic memory. The motion detector may signal the microprocessor to turn off the heating if the skate remains motionless for a long period of time Optionally the skate blade assembly 1 has in integrated heart rate sensor used to sense the heart rate of the skater. The heart rate sensor is connected to the microprocessor and may store heart rate data in the electronic memory.

Optionally the circuit board 9 has a radio frequency (RF) transmitter capable of wirelessly transmitting electronic digital or analog data intermittently or continuously collected from the skate electronics or sensors.

Figure 3:
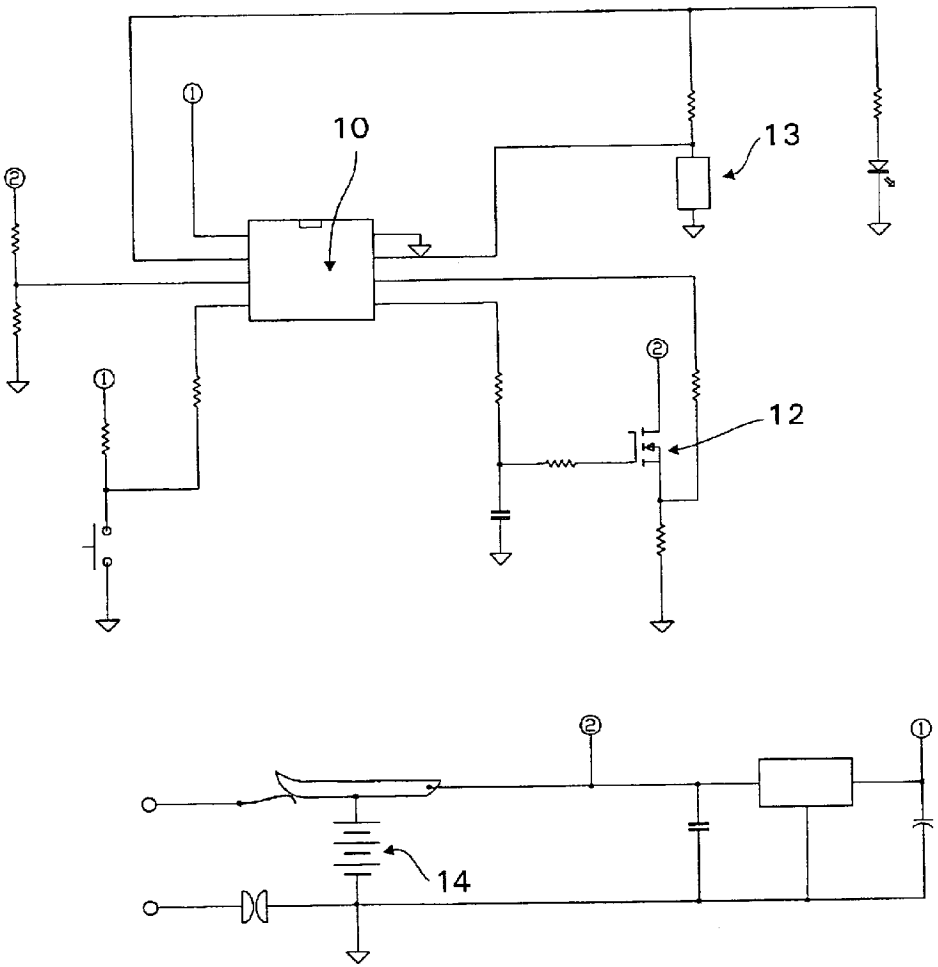
FIG. 3 is a schematic illustration of the heating circuit of the embodiment of FIG. 1.

The circuit, as illustrated in FIG. 3, has a microprocessor 10 which controls the temperature of the blade. The microprocessor 10 is connected to a temperature sensor 13 which senses when the heat to the blade should be turned on or off. During heating, there are two distinct states, heating on and heating off. The thermal conductor is fastened to the skate blade through which the electronic heating arrangement sends the thermal energy to heat the skate blade.

By taking a transistor 12 into the non-linear region of operation, a high efficiency heat source that operates with minimal radio frequency leakage is produced. As the self-destruct region of the power device is easily reached in the configuration, a microprocessor 10 is used to generate a continuously adapting drive waveform. Additionally, the microprocessor also manages the heating on-off, the average current flow, blade temperature and low battery shutdown.

The use of a blade as part of the tuned load as well as the heat sink permits dynamic tuning as a function of the target's current thermal/electrical resistance.

The power source is a rechargeable battery 14 and is regulated for circuit operation and used to supply the semiconductor 12, preferably a power MOS-FET semiconductor or field-effect transistor. This power MOS-FET or field-effect transistor is supplied power by the microprocessor. The resultant bias is used to operate a tuned snubbing network.

The processor is configured to deliver a buffered and shaped waveform to the power semiconductor 12. This waveform drives the power semiconductor 12. The battery 14 is regulated for circuit operation and used to supply the field effect transistor 12.

A temperature sensor 13 is used to monitor blade temperature. The temperature set point is adjustable.

Figure 4:
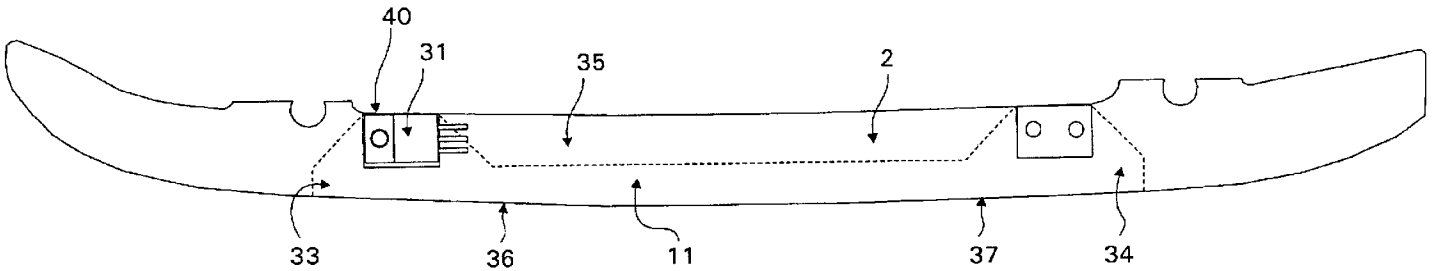
FIG. 4 is a side elevation view of a modified skate blade arrangement for use in the construction of FIG. 1 including a two part blade material.
Figure 5A:
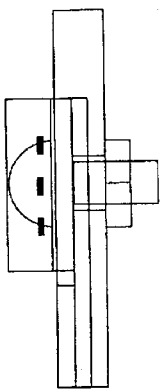
FIG. 5A is a cross section view the blade of FIG. 4.
Figure 5B:
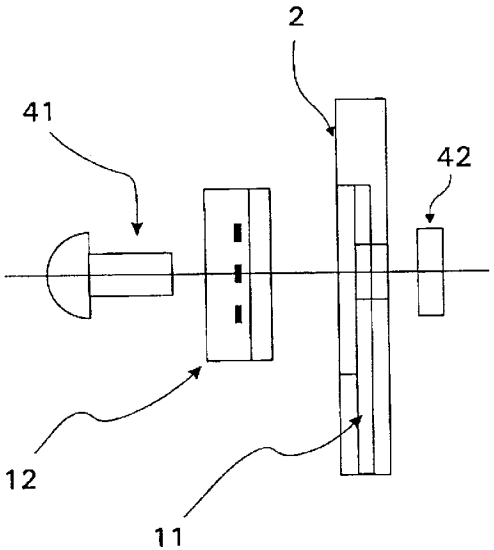
FIG. 5B is an exploded view of FIG. 5A.

FIGS. 4, 5A and 5B are shown a skate blade which is modified relative to the skate blade of the embodiment described above. In this arrangement the skate blade and the heat transfer thermal conductor 11 are formed as a common component providing a blade 2 and an insert portion 31. The insert portion 31 defines a strip 11 having a first end 33 and a second end 34 which is embedded within the steel blade 35. A bottom edge 36 of the insert portion 31 is coincident with a bottom edge 37 of the blade. The insert portion can be formed in a manner which extends from the bottom surface of the blade and then is machined in the conventional blade sharpening and forming process so that the bottom edge of the insert portion is machined down with the bottom surface of the blade to form a common sharpened blade edge.

The insert portion 31 extends from the forward edge 33 which is spaced rearward of the front end of the blade and is located adjacent the front mounting of the blade. The rear end 34 extends toward the rear mounting of the blade but is spaced forwardly therefrom. At the forward end, the insert portion tapers upwardly to a narrower upstanding portion 40 which extends to the top of the blade into the mounting to attach to the heating element as a heat sink therefore. The insertion portion is formed from a suitable material having a higher thermal conductivity than steel such as copper thus rapidly transferring the heat from the heating element away from the heating element through the upstanding portion 40, into the tapered portion which communicates the heat to the horizontal bottom elongate portion of the insert portion which is at the bottom edge of the blade so that the majority of the heat is transferred to the bottom edge of the blade rather than to other parts of the blade. Thus the insert portion along its main length has a relatively low height, less than 50% of the height of the blade itself thus carrying the heat primarily to this area. Conveniently the transistor 12 is fastened to the upper portion 40 of the thermal conductor insert 11 with a machine screw 41 and a nut 42. As shown in FIG. 5, the insert portion is sandwiched between two sides of the steel forming the blade so that the heat is transferred through the center of the blade to the required part of the steel adjacent the bottom edge of the blade.

Figures 6A, 6B:
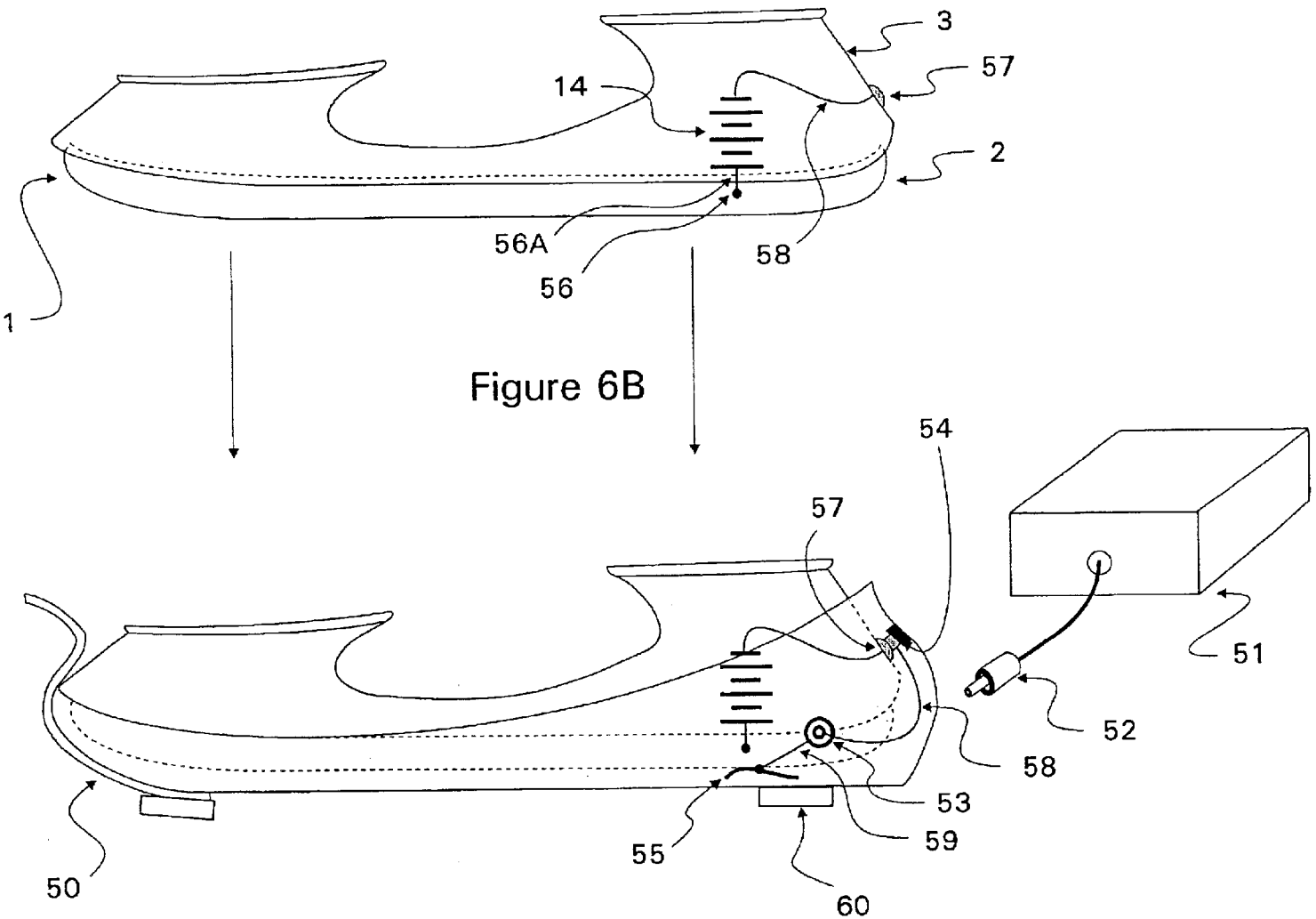
FIGS. 6A and 6B show a schematic illustration of a modified heating circuit for the embodiment of FIG. 1 in which the charging of the battery is effected through contact with the blade.

Turning now to FIGS. 6A and 6B, there is shown a skate guard and charging stand which is the with a modified circuit arrangement in which the blade itself is used as a contact through which current is supplied for recharging the battery. Thus the blade can be inserted into a skate guard which includes a contact for engaging the blade and a second contact for engaging a suitable ground contact on the skate at the mounting. Thus recharging the battery can be effected simply and quickly by mounting the skate in a suitable guard which provides the voltage at the required level to recharge the battery. Suitable circuit protection elements in the form of a diode are provided to prevent the battery from discharging through the blade during normal use.

The skate batteries charging system embodies a skate guard 50 which is supplied power from a transformer and electronics panel 51. A connector 52 from the charger electronics panel connects to a mating charging port 53 on the skate guard. Wires 58 and 59 connect the charging port with, respectively, a contact 54 on the heel of the skate guard and a spring contact 55 in the bottom slot of the skate guard.

Within the skate blade holder of the skate, one terminal of the battery 14 is connected through a wire 56A to a contact point 56 on the skate blade. The second battery terminal is connected through a wire 58 to a contact 57 on the heel of the skate blade holder.

When the skate 1 is positioned within the skate guard and charging stand 50 electrical contacts 54 and 57 connect and electrical contacts 55 and 56 connect completing the two wire charging circuit. The skate is held properly supported in the guard by stands 60 on the bottom of the guard.

While one embodiment of the present invention has been described in the foregoing, it is to be understood that other embodiments are possible within the scope of the invention. The invention is to be considered limited solely by the scope of the appended claims.

What is claimed is:

1. An ice skate comprising:

a boot arranged to receive a person's foot;

a skate blade assembly;

a blade mounting arrangement arranged to be connected to a sole of the boot and arranged to support a skate blade thereon, and;

a blade heating arrangement having a battery power source and a heating element for generating heat from electrical power supplied by the battery power source;

wherein the skate blade includes a steel blade portion and an insert portion embedded within the steel blade portion formed of a material having a higher thermal conductivity than the steel blade portion;

and wherein a part of the insert portion extends from the skate blade upwardly therefrom to the heating element to form a heat transfer member for transferring heat from the heating element to the steel blade portion.

2. The skate according to claim 1 wherein the insert portion is a plate parallel to a plane of the skate blade with the steel blade portion covering, both sides of the plate.

3. The skate according to claim 1 wherein the plate extends along a part only of the length of the steel blade portion.

4. The skate according to claim 1 wherein the plate extends to a bottom edge of the steel blade portion.

5. The skate according to claim 1 wherein the blade heating arrangement uses a field-effect transistor controlled by the microprocessor to operate in the non-linear range to heat the skate blade.

6. The skate according to claim 1 wherein at least part of the heating arrangement including the battery power source is mounted within the mounting arrangement and the insert portion extends from the blade to the mounting arrangement.

7. The skate according to claim 1 wherein the blade heating arrangement has a motion sensor arranged to control the heating of the blade such that when the skate is in use the blade is heated, when the skate is not in use the heat is off.

8. The skate according to claim 1 wherein the blade has sides which are insulated by a plastic material to provide an insulating layer between the blade and the air.

9. The skate according to claim 1 wherein a contact for connection to a charging system for charging the battery power source is defined by the blade.

10. A combination comprising a skate according to claim 9 and a charging system wherein the charging system includes a first contact for engaging the blade and a second contact for engaging the skate at a position thereon spaced from the blade.

11. The combination according to claim 10 wherein the charging system comprises a skate guard for receiving and holding the blade of the skate.

12. The combination according to claim 11 wherein the skate guard has a first contact for engaging the blade and a second contact spaced from the blade.

13. The combination according to claim 12 wherein the first contact and the second contact are connected to a port on the skate guard for connection to a separate charger.

* * * * *